US008443528B2

(12) United States Patent
Kann

(10) Patent No.: US 8,443,528 B2
(45) Date of Patent: May 21, 2013

(54) RAINPROOF SHOE COVER

(76) Inventor: Michael Kann, Taipei (TW)

( * ) Notice: Subject to any disclaimer, the term of this patent is extended or adjusted under 35 U.S.C. 154(b) by 187 days.

(21) Appl. No.: 13/190,477

(22) Filed: Jul. 26, 2011

(65) Prior Publication Data

US 2012/0011750 A1 Jan. 19, 2012

Related U.S. Application Data

(63) Continuation-in-part of application No. 12/838,431, filed on Jul. 17, 2010.

(51) Int. Cl.
*A43B 3/20* (2006.01)
*A43B 23/00* (2006.01)

(52) U.S. Cl.
USPC ..... 36/7.2; 36/137; 36/101; 36/72 R

(58) Field of Classification Search
USPC ..... 36/7.2, 138, 72 R, 101, 7.1 R, 137, 36/1.5, 2 R
See application file for complete search history.

(56) References Cited

U.S. PATENT DOCUMENTS

| | | | | |
|---|---|---|---|---|
| 4,259,791 | A * | 4/1981 | Bazan | 36/7.2 |
| 4,910,890 | A * | 3/1990 | Morell et al. | 36/117.7 |
| 5,337,491 | A * | 8/1994 | Mascotte | 36/7.1 R |
| 5,829,170 | A * | 11/1998 | Lutz, Jr. | 36/72 R |
| 5,926,978 | A * | 7/1999 | Smith | 36/101 |
| 7,523,567 | B1 * | 4/2009 | McClelland | 36/115 |
| 2002/0178616 | A1 * | 12/2002 | Williams | 36/97 |
| 2012/0317842 | A1 * | 12/2012 | McClelland | 36/115 |

* cited by examiner

*Primary Examiner* — Ted Kavanaugh

(57) ABSTRACT

A bottomless rainproof shoe cover assembly includes a shoe cover and a fixture. The shoe cover is formed into one body by injection molding. One side of the shoe cover is provided with a lateral opening. Fastening tapes are provided on both sides of the lateral opening. The lower periphery of the shoe cover is provided with protrusions. The top surface of the shoe cover is provided with protrusions to form a fixing trough. Both sides of the fixing trough are provided with a positioning hole. The fixture is positioned in the fixing trough for keeping the shoe cover in shape. The present invention provides a greater degree of coverage and convenience in use. Further, the manufacturing process, the amount of materials and the cost are reduced.

10 Claims, 5 Drawing Sheets

RAINPROOF SHOE COVER

CROSS-REFERENCE TO RELATED APPLICATIONS

This application is a continuation-in-part of U.S. application Ser. No. 12/838,431, filed on Jul. 17, 2010, the contents of which are incorporated herein by reference.

BACKGROUND OF THE INVENTION

1. Field of the Invention

The present invention relates to a bottomless rainproof shoe cover assembly, and in particular to a bottomless rainproof shoe cover assembly that is formed into one body, whereby the durability and production efficiency thereof are increased while the material waste and cost are reduced.

2. Description of Prior Art

On rainy days, umbrellas and raincoats are generally used to keep rain off an individual. However, rainwater is still apt to be absorbed on the legs, shoes and socks, which is a source of trouble. To this end, shoe covers with a bottom have been provided for protecting the shoes from rainwater. However, these shoe covers are suitable only for shoes of a particular shape and thus are not be effective with shoes having different shapes, which makes the user inconvenient to put on or take off. As for those who use umbrellas and ride a motorcycle, they cannot take off the shoe covers easily.

Taiwan Patent No.M391320, CN Patent Application No.2010202407221, Japan Application No.2011-2931, U.S. patent application Ser. No.12/838,431, and PCT Patent Application No. PCT/CN2010/080172 filed by the applicant of the present invention disclose a rainproof shoe cover capable of being rapidly put on and taken off. As shown in FIG. 1, the bottomless rainproof shoe cover 5 comprises a front cover sheet 50 and a rear cover sheet 51. A fixture 53 is fixed onto the joint between the front cover sheet 50 and the rear cover sheet 51. The inner periphery of the front cover sheet 50 is provided with a framing strip 52. Side ends of the rear cover sheet 51 are provided with fastening tapes 510, 511. By this arrangement, the user can wear the rainproof shoe cover quickly. The fixture 53 tightly covers and fixes the rainproof shoe cover to shoes having different shapes. The framing strip 52 is also configured to cover the front edge of the bottom of the shoe having different shapes, so that the user can be protected from rainwater, cold, insects and snakes.

However, such a conventional bottomless rainproof shoe cover is made by integrating the front cover sheet, the rear cover sheet and the fixture together, so that the manufacturing process thereof is complicated, the amount of materials and labor hours are increased. Therefore, the applicant proposes a novel structure to reduce labor hours, materials and cost while increasing the production efficiency.

SUMMARY OF THE INVENTION

In order to solve the above problems, the present invention is to provide a bottomless rainproof shoe cover assembly including a rainproof shoe cover and a fixture. The rainproof shoe cover is formed into one body by injection molding. One side of the rainproof shoe cover is provided with a lateral opening. The fixture is disposed on the top surface of the rainproof shoe cover for fixing the rainproof shoe cover onto a shoe.

According to a preferred embodiment of the bottomless rainproof shoe cover assembly of the present invention, it is characterized in that the rainproof shoe cover is formed into one body by injection molding.

According to a preferred embodiment of the bottomless rainproof shoe cover assembly of the present invention, it is characterized in that the surface of the rainproof shoe cover is provided with stitching lines, leather grains or geometrical patterns at proper positions during the injection molding.

According to a preferred embodiment of the bottomless rainproof shoe cover assembly of the present invention, it is characterized in that the lower periphery of the rainproof shoe cover is provided with protrusions.

According to a preferred embodiment of the bottomless rainproof shoe cover assembly of the present invention, it is characterized in that a LED lamp is mounted between the protrusions of the rainproof shoe cover for increasing the safety in rainy days and nighttime.

According to a preferred embodiment of the bottomless rainproof shoe cover assembly of the present invention, it is characterized in that the protrusions encloses to form a fixing trough having a position hole on the top surface of the rainproof shoe cover.

According to a preferred embodiment of the bottomless rainproof shoe cover assembly of the present invention, it is characterized in that the opening of the rainproof shoe cover is provided with fastening tapes. The fastening tapes have a wide element and a narrow element facing to each other.

According to a preferred embodiment of the bottomless rainproof shoe cover assembly of the present invention, it is characterized in that both sides of the fixture are provided with a fixing hole respectively. Each end of the fixture is formed with at least one bending portion. The bottom surface of the fixture is provided with skid-proof embossments.

According to a preferred embodiment of the bottomless rainproof shoe cover assembly of the present invention, it is characterized in that the surface of the fixture is adhered with a reflective film or coated with a reflective coating, thereby providing safety in rainy days and nighttime.

According to a preferred embodiment of the bottomless rainproof shoe cover assembly of the present invention, it is characterized in that the fixture is fixed to the rainproof shoe cover by a fastener or a binder, thereby increasing the convenience in replacement.

According to a preferred embodiment of the bottomless rainproof shoe cover assembly of the present invention, it is characterized in that the fixture is embedded as a serpentine spring.

According to a preferred embodiment of the bottomless rainproof shoe cover assembly of the present invention, it is characterized in that the fixture is embedded in the rainproof shoe cover during the injection molding.

The detailed description and technical contents of the present invention will be made with reference to the accompanying drawings.

DETAILED DESCRIPTION OF THE INVENTION

The present invention is directed to a bottomless rainproof shoe cover assembly including a shoe cover and a fixture. The shoe cover is formed into one body by injection molding and combined with the fixture. One side of the shoe cover is provided with a lateral opening. The edge of the shoe cover is provided with a fastening tape. The lower periphery of the shoe cover is provided with a plurality of protrusions. The protrusions enclose to form a fixing trough on the top surface of the shoe cover. Both sides of the fixing trough are provided with a positioning hole respectively. The fixture is accommodated and positioned in the fixing trough for covering the shoe cover and keeping it in a desired shape. With the combination of the integrally-formed shoe cover and the fixture, the degree of coverage and convenience in use are increased, while the manufacturing process and material waste are reduced.

Figure 1:
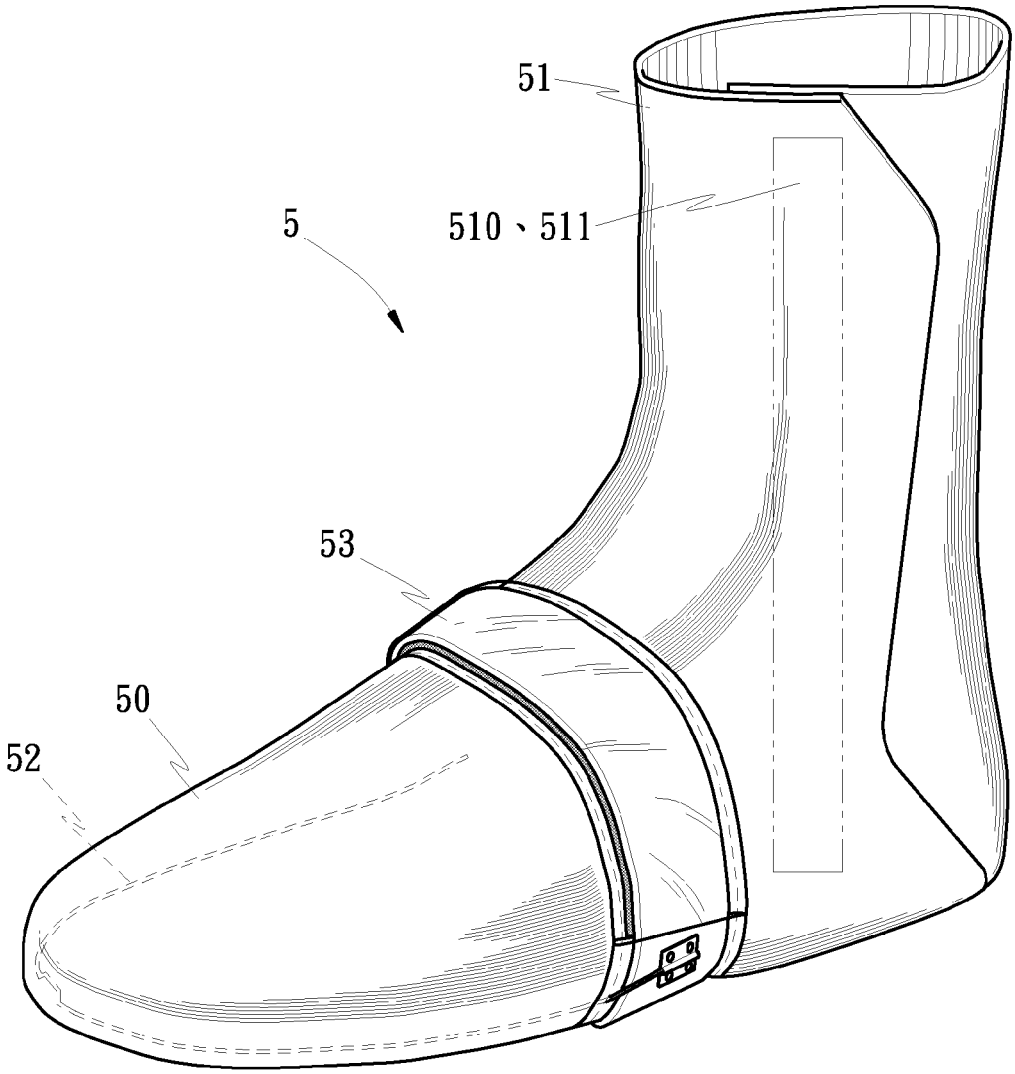
FIG. 1 is a schematic view showing the structure of a bottomless rainproof shoe cover in prior art.
Figure 2:
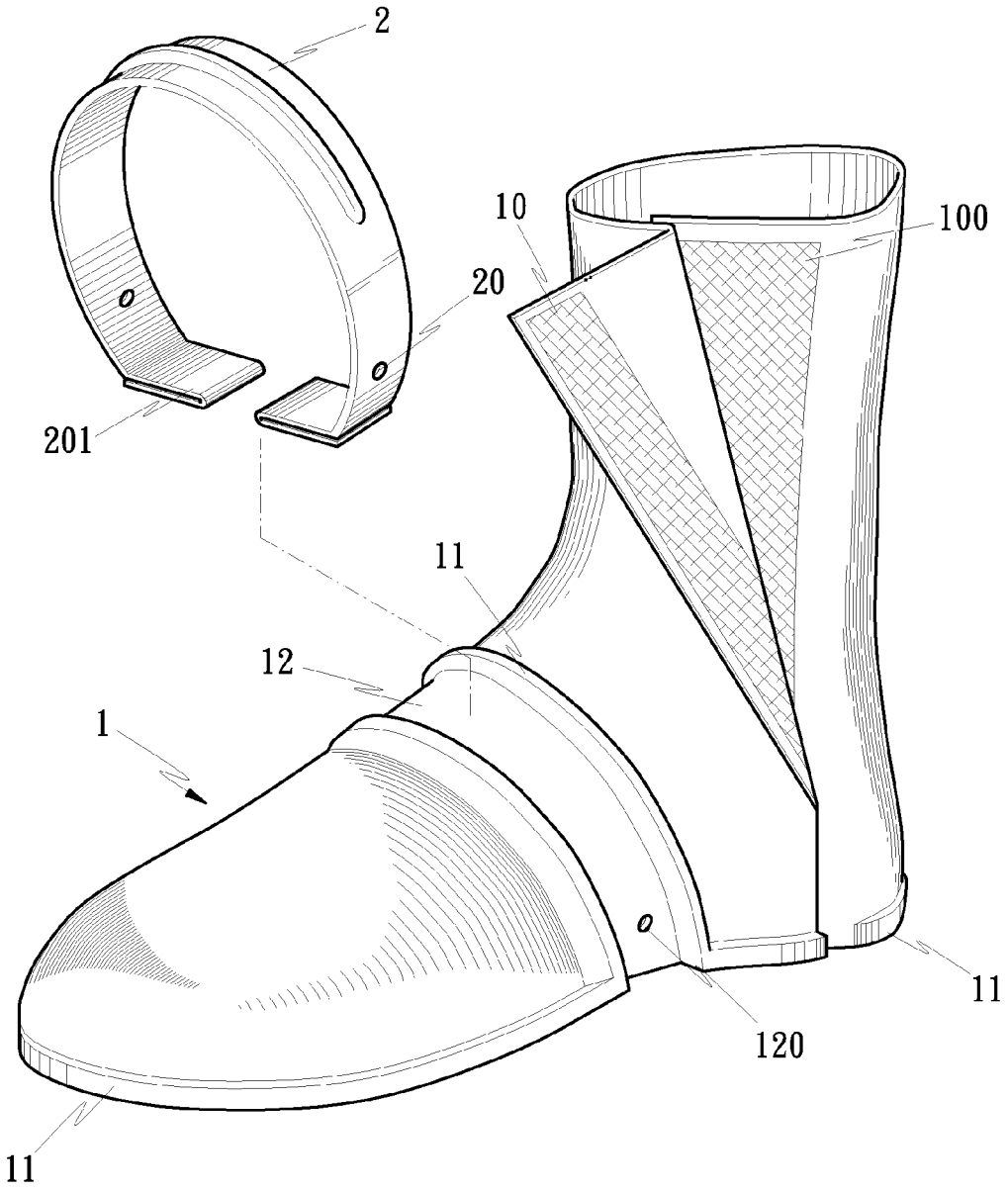
FIG. 2 is an exploded perspective view showing the bottomless rainproof shoe cover assembly of the present invention.
Figure 7:
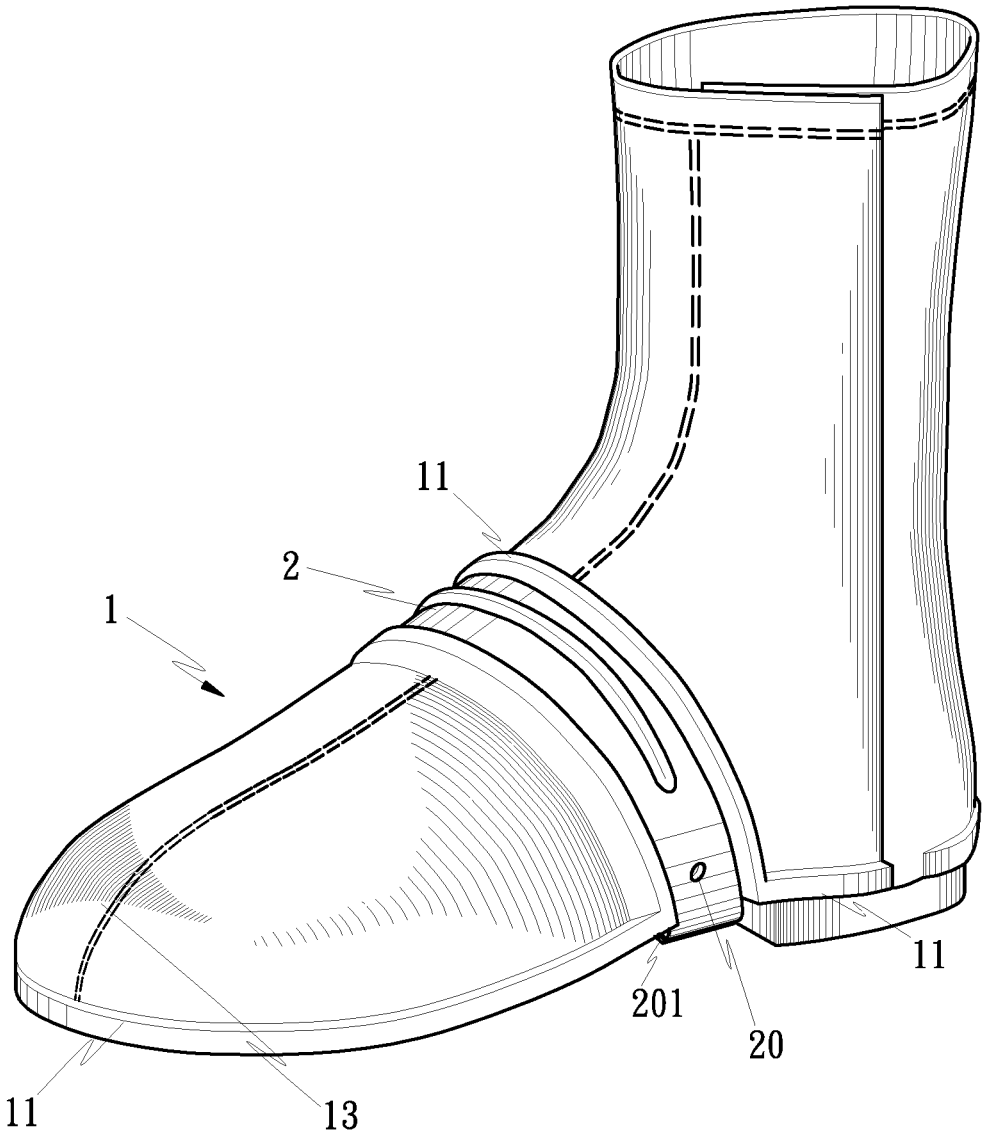
FIG. 7 is a schematic view showing the external appearance of the bottomless rainproof shoe cover assembly of the present invention.

With reference to FIGS. 2 and 7, the bottomless rainproof shoe cover 1 is formed into one body by injection molding of plastic materials. The above-mentioned plastic materials are green materials, in which a suitable ratio of biodegradable materials are blended for promoting landfill decomposition and incineration. The fixture 2 is configured to fix the bottomless rainproof shoe cover 1 onto the surface of a shoe.

The bottomless rainproof shoe cover 1 is formed into one body by injection molding, which has a shape similar to that of a boot. The shoe cover 1 is open near the bottom of the shoe, so that the shoe cover 1 is bottomless. One side surface of the shoe cover 1 has a lateral opening, so that a user can put on the shoe cover 1 easily and quickly. The bottomless rainproof shoe cover 1 is provided at suitable positions with stitching lines, leather grains, or geometrical patterns during the injection molding, so that the bottomless rainproof shoe cover 1 looks like a riding boot. Since the shoe cover 1 is bottomless, it is capable of fitting shoes having different shapes and sizes. Fastening tapes 10, 100 are provided on both sides of the lateral opening of the shoe cover 1, in which the fastening tapes 10, 100 comprise a narrow fastening tape 10 and a wide fastening tape 100. By this arrangement, the shoe cover 1 is adjustable to fit the shoes having different lengths and outer profiles.

The lower periphery of the bottomless rainproof shoe cover 1 is provided with a plurality of protrusions 11 for promoting the fixation of the shoe cover 1 on the shoe and the resistance of abrasion when contacting the ground. The top surface of the front section of the bottomless rainproof shoe cover 1 is provided with a plurality of protrusions enclosing to form a fixing trough 12. Both sides of the fixing trough 12 are provided with a positioning hole 120 respectively. The fixture 2 is accommodated in the fixing trough 12. Both sides of the fixture 2 are provided with a fixing hole 20 respectively to correspond to the positioning hole 120.

The fixture 2 is formed like a horse's hoof and is flexible for deformation. Both sides of the fixture 2 are provided with the fixing hole 20 respectively. Two ends 201 of the fixture 2 are formed with at least one bending portion to increase the durability and degree of coverage. The fixture 2 is fixed into the fixing trough 12 of the bottomless rainproof shoe cover 1. In use, the bottomless rainproof shoe cover 1 is put on the surface of the shoe via the lateral opening, and then the fixture 2 is fixed into the fixing trough 12, whereby the bottomless rainproof shoe cover 1 can be firmly put on the surface of the shoe.

Figure 3:
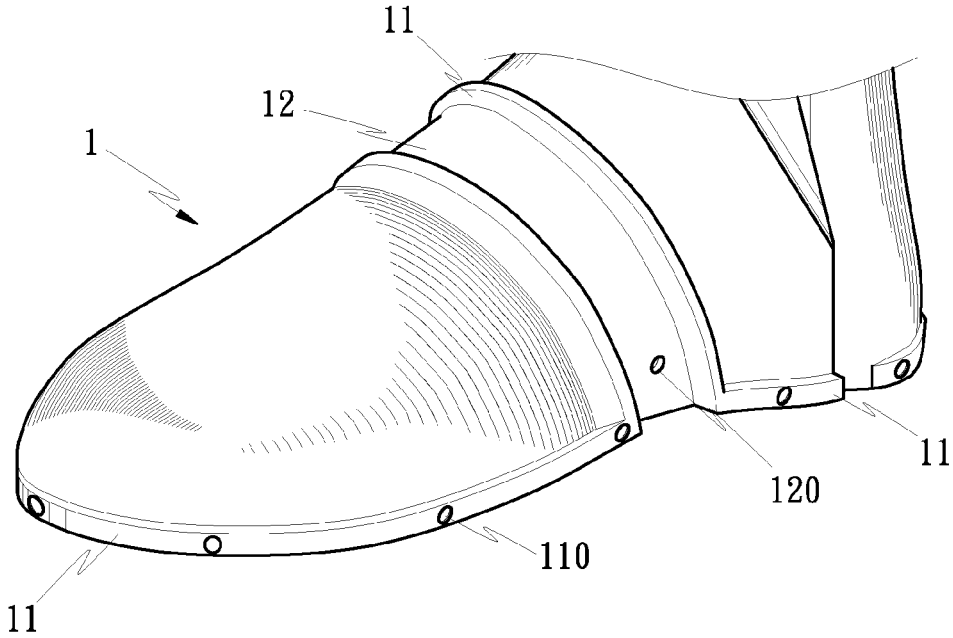
FIG. 3 is a schematic view showing the protrusions in the bottomless rainproof shoe cover assembly of the present invention.
Figure 4:
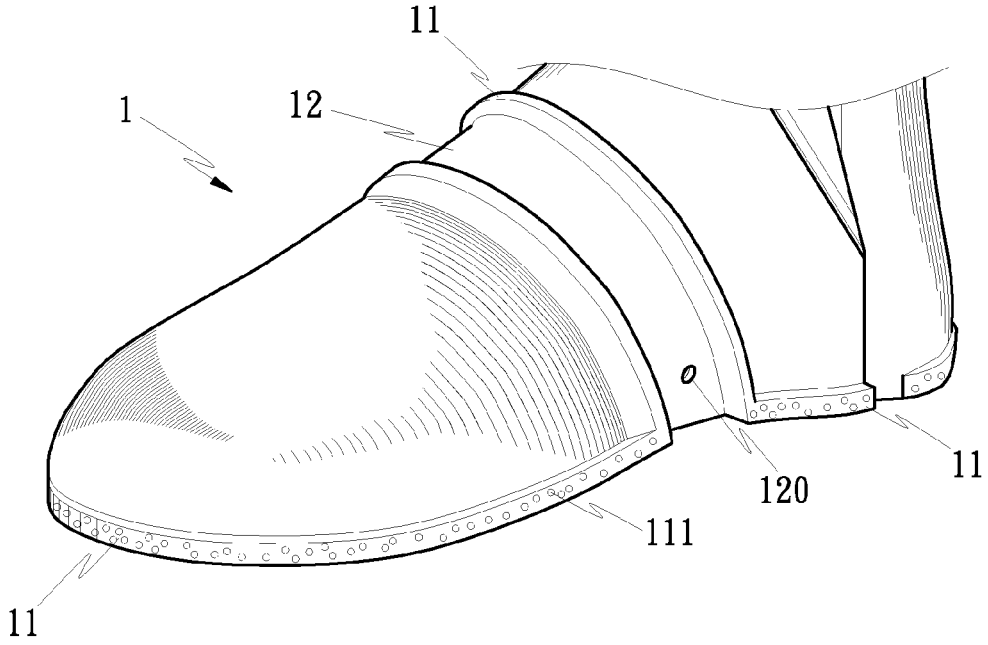
FIG. 4 is a schematic view showing another arrangement of the protrusions in the bottomless rainproof shoe cover assembly of the present invention.

Please also refer to FIGS. 3 and 4. As mentioned in the above, the bottomless rainproof shoe cover 1 is formed into one body by injection molding of plastic materials. The lower periphery of the bottomless rainproof shoe cover 1 is provided with the protrusions 11 for promoting the fixation of the shoe cover 1 onto the shoe and the resistance of abrasion when contacting the ground. As shown in FIGS. 3 and 4, since the visibility is not good on rainy days, and even much worse on heavy cloudy days or at night, LED lamps 10 may be mounted between the protrusions 11 formed on the lower periphery of the bottomless rainproof shoe cover 1. Alternatively, reflective materials 111 or light-absorbing materials are blended in the shoe cover 1 during the injection molding, thereby increasing the safety when using on rainy or heavy cloudy days and at night.

Figure 5:
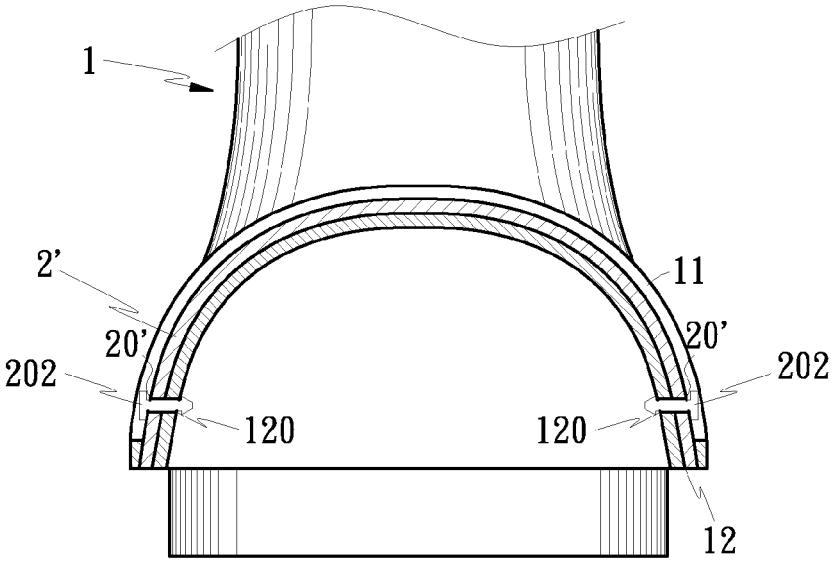
FIG. 5 is a front cross-sectional view showing the fixture in the bottomless rainproof shoe cover assembly of the present invention.
Figure 6:
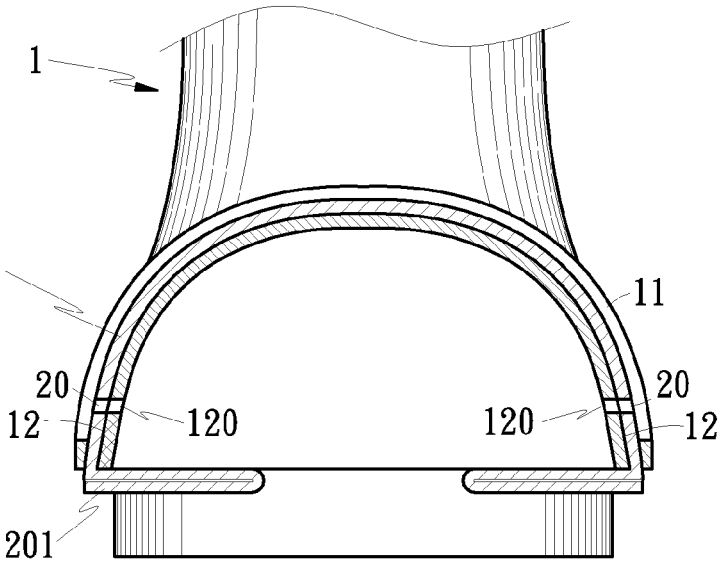
FIG. 6 is a front cross-sectional view showing another type of the fixture in the bottomless rainproof shoe cover assembly of the present invention.

Please refer to FIGS. 5 and 6. The bottomless rainproof shoe cover 1 is put on the outer surface of the shoe to keep rainwater off legs of the user on rainy days. When the bottomless rainproof shoe cover 1 is put on the outer surface of the shoe, the fixture 2 is fastened onto the outer surface of the shoe cover 1. The fixture 2 may be embodied as a fixture 2' without the ends 201 as shown in FIG. 5. Both sides of the fixture 2' are formed with a fixing hole 20' to correspond to the positioning hole 120 on both sides of the fixing trough 12. Then, a fastener 202 is disposed through the fixing holes 20' for fixing the fixture 2' onto the shoe. Alternatively, a binder may be used for this purpose. The fastener 202 may be made of plastics, fiber-reinforced plastics or metals. In the fixture 2 having the ends 201 as shown in FIG. 6, each of the ends 201 of the fixture 2 is formed with at least one bending portion. Further, the bottom surface of the fixture 2 is provided with skid-proof embossments for providing a skid-proof effect. The surface of the fixture 2 or 2' is coated with a reflective coating or adhered with a reflective film, thereby increasing the safety at night. Further, the fixture 2 or 2' may be embodied as a serpentine spring to reduce the production cost.

According to the above, by using the bottomless rainproof shoe cover assembly of the present invention including an integrally-formed shoe cover and the combined fixture, the amount of materials, time for injection molding, weight and volume of the final product can be reduced. Further, the present invention is capable of fitting shoes having different sizes and being rapidly put on or taken off.

What is claimed is:

1. A bottomless rainproof shoe cover assembly, including a shoe cover and a fixture, characterized in that:

the shoe cover is formed into one body by injection molding and has a shape like a boot, one side of the shoe cover is provided with a lateral opening and fastening tapes, the shoe cover is bottomless, a lower periphery of the shoe cover is provided with protrusions, a top surface of a front section of the shoe cover is provided with a fixing trough having a plurality of positioning holes, the fixture is fixed onto the fixing trough, the fixture is formed like a horse's hoof, both ends of the fixture are formed with at least one bending portion respectively, fixing holes are provided in the fixture, the fixture is fixed onto the surface of the shoe cover, whereby the amount of materials, time for injection molding, weight and volume of final products are reduced, the bottom rainproof shoe cover assembly is capable of fitting shoes of different lengths and being rapidly put on or taken off.

2. The bottomless rainproof shoe cover assembly according to claim 1, wherein the surface of the shoe cover is provided with stitching lines, leather grains or geometrical patterns.

3. The bottomless rainproof shoe cover assembly according to claim 1, wherein LED lamps, reflective materials or light-absorbing materials are disposed in the protrusions.

4. The bottomless rainproof shoe cover assembly according to claim 1, wherein a lower surface of one end of the fixture is provided with skid-proof embossments.

5. The bottomless rainproof shoe cover assembly according to claim 1, wherein the surface of the fixture is adhered with a reflective film or coated with a reflective coating.

6. The bottomless rainproof shoe cover assembly according to claim 1, wherein both ends of the fixture are not bent.

7. The bottomless rainproof shoe cover assembly according to claim 1, wherein the positioning hole of the fixing trough is located to correspond to the fixing hole, a fastener or binder is used to fasten the fixture into the fixing trough.

8. The bottomless rainproof shoe cover assembly according to claim 1, wherein the fastener is made of plastics, fiber-reinforced plastics or metals.

9. The bottomless rainproof shoe cover assembly according to claim 1, wherein the fixture is a serpentine spring.

10. The bottomless rainproof shoe cover assembly according to claim 1, wherein the fixture is made of plastics, fiber-reinforced plastics or metals.

* * * * *